US006382093B1

(12) United States Patent
Hara

(10) Patent No.: US 6,382,093 B1
(45) Date of Patent: May 7, 2002

(54) STENCIL PRINTING MACHINE HAVING CONTROLLED TRANSPORT OF STENCIL TO CONTAINER

(75) Inventor: Yoshikazu Hara, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/472,507

(22) Filed: Dec. 27, 1999

(30) Foreign Application Priority Data

Dec. 28, 1998 (JP) ..... 10-374389

(51) Int. Cl.[7] ..... B41L 13/06
(52) U.S. Cl. ..... 101/116; 101/114; 101/477
(58) Field of Search ..... 101/114, 116, 101/117, 118, 128.4, 129, 477, 484

(56) References Cited

U.S. PATENT DOCUMENTS

| | | | | |
|---|---|---|---|---|
| 5,165,338 A | * | 11/1992 | Okazaki et al. | 101/118 |
| 5,487,333 A | * | 1/1996 | Oshio et al. | 101/116 |
| 5,623,871 A | * | 4/1997 | Takahira | 101/116 |
| 5,632,200 A | * | 5/1997 | Fukai | 101/114 |
| 6,158,337 A | * | 12/2000 | Hara | 101/116 |

FOREIGN PATENT DOCUMENTS

| | | | |
|---|---|---|---|
| EP | 0 696 514 | | 2/1996 |
| EP | 0 888 899 | | 1/1999 |
| JP | 64-24783 | * | 1/1989 |

* cited by examiner

*Primary Examiner*—Leslie J. Evanisko
(74) *Attorney, Agent, or Firm*—Fitch, Even, Tabin & Flannery

(57) ABSTRACT

A stencil printing machine in which a stencil is sheared off of a continuous roll of stencil sheet to a length determined by a selected size of printing paper, mounted onto a printing drum, removed from said printing drum, and transported to and inserted into a used stencil container by a transport means, which comprises a stencil length specifying means which specifies the length of the stencil according to a selected size of printing paper when the stencil is prepared for printing, and a control means which controls an operation amount of the transport means, at the time the stencil is removed from the printing drum, in relation to the length of the stencil as specified by the stencil length specifying means. The control means may comprise a random access memory to record the data from the stencil length specifying mechanism. The operation amount of the transport means can be related to rotation angle of the printing drum, and operation of the transport means may be terminated by detection of a rotational angle of said printing drum at which said used stencil is completely transported and deposited into said used stencil container can be detected.

7 Claims, 11 Drawing Sheets

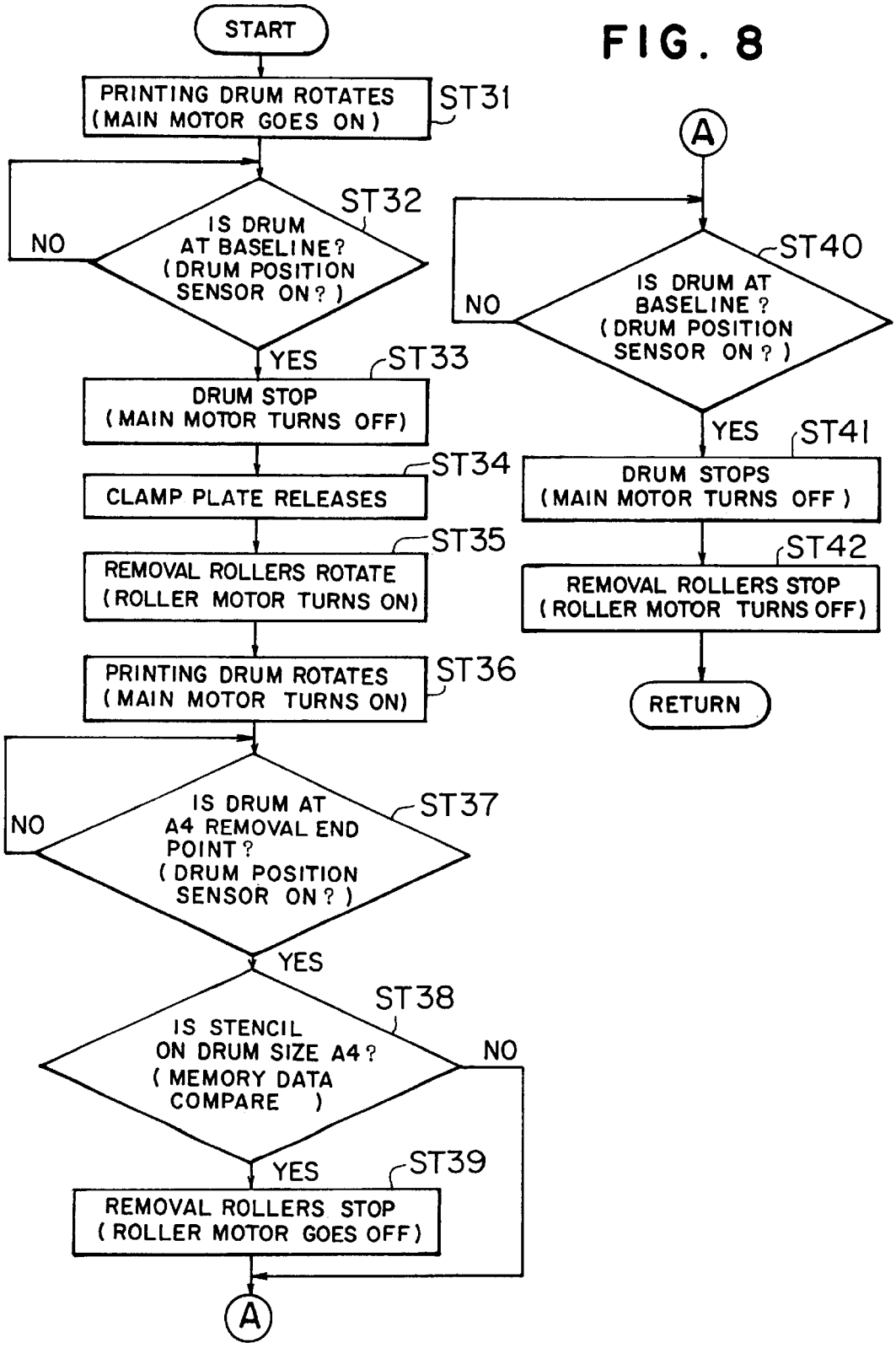
FIG. 8
START
PRINTING DRUM ROTATES (MAIN MOTOR GOES ON)
ST31
IS DRUM AT BASELINE? (DRUM POSITION SENSOR ON?)
ST32
NO
YES
DRUM STOP (MAIN MOTOR TURNS OFF)
ST33
CLAMP PLATE RELEASES
ST34
REMOVAL ROLLERS ROTATE (ROLLER MOTOR TURNS ON)
ST35
PRINTING DRUM ROTATES (MAIN MOTOR TURNS ON)
ST36
IS DRUM AT A4 REMOVAL END POINT? (DRUM POSITION SENSOR ON?)
ST37
NO
YES
IS STENCIL ON DRUM SIZE A4? (MEMORY DATA COMPARE)
ST38
NO
YES
REMOVAL ROLLERS STOP (ROLLER MOTOR GOES OFF)
ST39
A
A
IS DRUM AT BASELINE? (DRUM POSITION SENSOR ON?)
ST40
NO
YES
DRUM STOPS (MAIN MOTOR TURNS OFF)
ST41
REMOVAL ROLLERS STOP (ROLLER MOTOR TURNS OFF)
ST42
RETURN

STENCIL PRINTING MACHINE HAVING CONTROLLED TRANSPORT OF STENCIL TO CONTAINER

BACKGROUND OF THE INVENTION

1. Field of the Invention

The invention relates to a stencil printing machine of the type capable of preparing a stencil from a continuous roll of stencil sheet, said stencil being cut to a dimension according to a selected size of printing paper, attaching the aforesaid stencil to a printing drum, and printing the stencil image onto the printing paper. When the need to print from a new stencil arises, the printing machine is further capable of removing the used stencil from the aforesaid printing drum and transporting the used stencil to a container by means of a stencil removal mechanism.

2. Background

Conventional stencil printing machines, specifically those types that make use of a printing drum capable of accommodating paper sizes up to A3, are normally able to print on paper sizes smaller than A3. In cases where paper sizes smaller than A3 are printed, an A3 size stencil must still be cut off of the roll of stencil sheet and attached to the printing drum. When this type of printing machine is used to print a relatively small number of copies, the cost of the stencil can become the largest expense per sheet printed.

In order to reduce stencil expenses, a stencil making apparatus has been put forth wherein multiple separate printing drums having A3, B4, A4 and/or other size printing surfaces are utilized, these printing drums being of a replaceable design so as to allow the use of a specific drum corresponding to the size of the paper intended for the printing job. A structure is generally utilized whereby the aforesaid printing drums are constructed to a uniform diameter, and their ink-permeable printing regions disposed so as to begin at a common baseline where an adjacent clamp mechanism is provided, but to end at a location corresponding to the length of the paper size for which the drum was intended.

Moreover, a stencil printing machine has been proposed wherein a single printing drum is used to accommodate the mounting of various size stencils cut to conform to A3, B4, A4, and/or other dimensions. In cases where B4 or A4 size stencils are wound around the drum, the drum surface printing region lying beyond the end of the stencil is exposed, thus making it necessary to provide a control mechanism to prevent the press roller from pressing the region of the drum surface not covered by the stencil.

In the stencil making printing machines discussed above, a stencil is unwound and prepared from a continuous roll of stencil sheet and cut to a dimension according to a selected size of printing paper before wound around the drum, and thus more economical use of the stencil sheet is made, whereby printing costs can be reduced.

Current stencil printing machines generally provide means of removing the used stencil from the aforesaid printing drum, and removal rollers as means of transporting the used stencil to a used stencil container when a new stencil is to be prepared. The used stencil cannot be deposited completely into the used stencil container unless the rotational duration of the removal rollers exceeds a linear distance equivalent to the length of the stencil being removed from the drum. The rotational duration of the removal rollers is thus generally established, while also taking the length of the stencil removal traverse path into consideration, so as to slightly exceed a linear distance equivalent to the length of the largest usable stencil which is, in many cases, an A3 size stencil.

In cases where a stencil smaller than the largest permissible stencil is mounted to the drum, the removal rollers continue to rotate after the used stencil is completely deposited in the used stencil container, thus posing a potential problem whereby used stencils already transported and placed into the container may become entangled in the turning removal rollers after the most recent used stencil has been deposited.

SUMMARY OF THE INVENTION

The invention, in consideration of the aforesaid used stencil entanglement problem, offers a structure for a stencil printing machine of the type capable of cutting a stencil from a roll of stencil sheet to a length corresponding to the length of the printing paper, attaching the aforesaid stencil to the circumference of a drum, removing the stencil from said drum when a new stencil is to be prepared, and transporting said stencil to a used stencil container by means of a transport mechanism; wherein operation of the aforesaid stencil transport mechanism is specifically controlled so as to stop traverse of the used stencil at a point immediately after said stencil is completely deposited in the aforesaid used stencil container.

The invention, as means of realizing the aforesaid operation, offers a structure for a stencil printing machine of the type capable of cutting a stencil from a roll of stencil sheet to a length corresponding to a selected size of printing paper, attaching the aforesaid stencil to the circumference of a drum, detaching the stencil from said drum when a new stencil is to be attached, and transporting said stencil to a used stencil container by means of a stencil removal transport mechanism; wherein a stencil length specifying means is provided to determine the length of the stencil according to the monitored length of the printing paper selected for that specific printing job, and a control means is provided to control operation of the aforesaid transport mechanism in relation to the length of the stencil when said stencil is removed. The length of the aforesaid stencil is established as the length of that stencil when attached and extending around the external circumference of the aforesaid drum.

The aforesaid control means may be comprised of memory means that holds stencil length data in memory as specified by the aforesaid stencil length specifying means, monitoring means that determines the minimum extent of transport needed to completely carry each of various size stencils to and into the aforesaid used stencil container by the aforesaid transport means, and termination means that stops the operation of the aforesaid transport means based on a comparison calculation of the length of the aforesaid stencil monitored by the aforesaid monitoring means and the stencil length data held in memory by the aforesaid memory means.

While an ordinary positional relationship is maintained between the drum and the used stencil container, the stencil is normally completely inserted into the used stencil container within the time required for one revolution of the drum, thus establishing a direct correlation between the stencil removal process and the revolving angle of the drum. It thus becomes desirable to structure the aforesaid monitoring means so as to monitor a rotational angle of the drum as means of establishing a specific traverse distance of the aforesaid transport means, said traverse distance being equal to the minimum distance required to deposit a specific size stencil into the used stencil container.

The aforesaid monitoring means may be comprised of a first trigger plate fixedly attached to the radial peripheral edge of the drum, a separate trigger plate fixedly attached to the peripheral edge of the drum at a point of specific rotational angle spaced from the aforesaid first sensor plate in a direction opposite to the drum rotating direction, and a stationary sensor capable of detecting the aforesaid first and separate trigger plates. The first trigger plate is advantageously positioned at a location at which it can trigger the aforesaid stationary sensor at the point where the printing drum begins its rotation movement upon removal of the used-stencil from the drum.

The aforesaid monitoring means may also be structured in the form of a rotational angle reading encoder, or other like means, capable of continuously monitoring the rotational position of the drum whereby an angle of drum rotation can be applied to the establishment of the aforesaid specific traverse distance of the transport mechanism.

A further purpose of the invention is to provide means of controlling operation of the transport means without employing the aforesaid stencil length specifying means. In other words, the invention offers a structure for a stencil making printing machine of the type capable of cutting a stencil from a roll of stencil sheet to a length corresponding to the length of the printing paper, attaching the aforesaid stencil to the circumference of a printing drum, detaching the stencil from said drum, and providing means to transport said stencil to a used stencil container; wherein a removal sensor is provided in proximity to the aforesaid used stencil container as means of monitoring the passage of a used stencil, said sensor being applied in a way in which the operation of the aforesaid transport mechanism can be stopped in relation to the passage of the aforesaid used stencil.

BRIEF DESCRIPTION OF THE DRAWING

FIG. 8 is a flow chart describing the operation of the stencil removal process shown in FIG. 6.

DETAILED DESCRIPTION OF THE PREFERRED EMBODIMENTS

Figure 1:
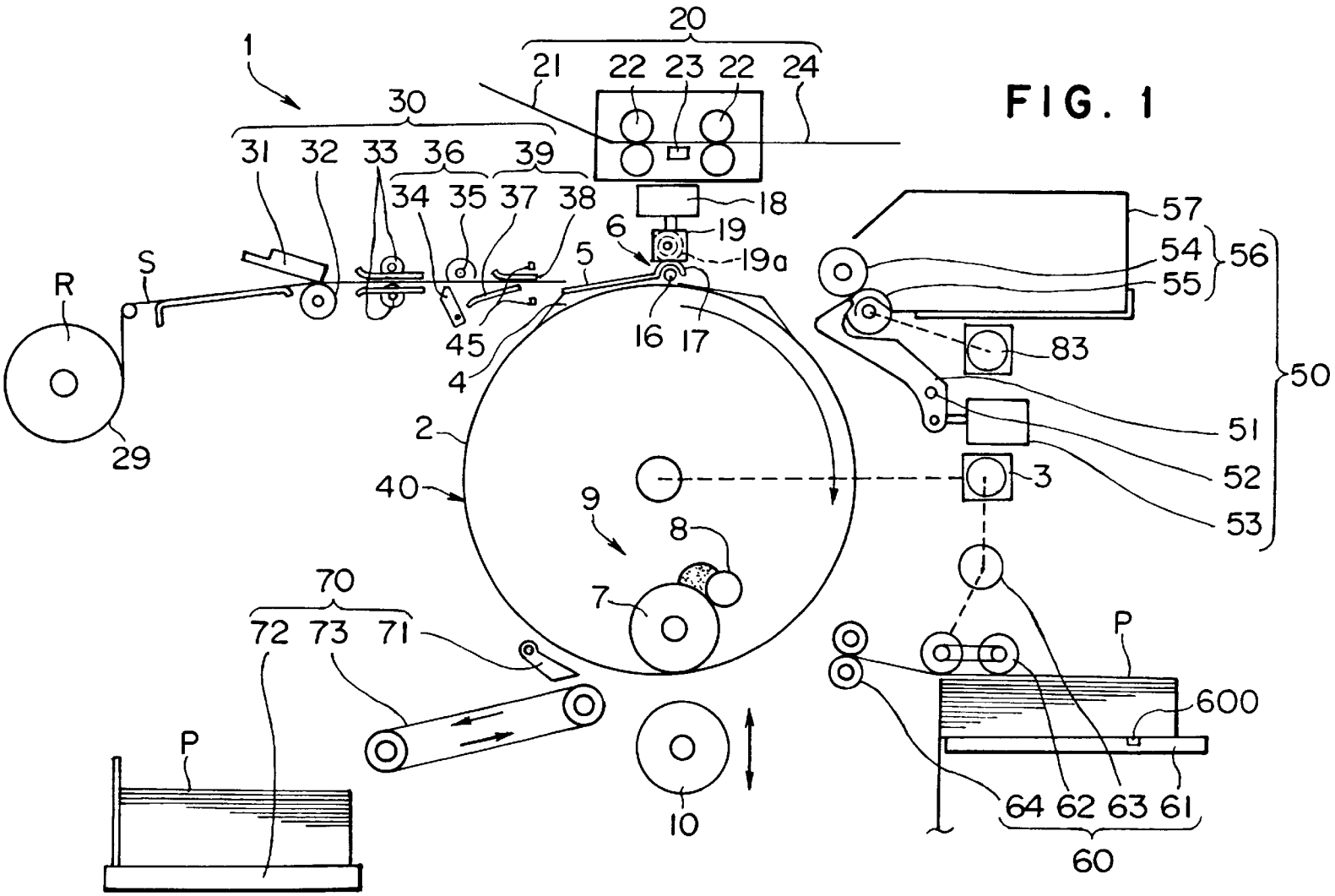
FIG. 1 is a detailed schematic illustration of an embodiment of the invention.

FIG. 1 explains a first embodiment of the stencil making printing machine of the present invention. Printing machine 1 is primarily comprised of image reading unit 20, thermal stencil making unit 30, printing unit 40, used stencil removal unit 50, paper feed unit 60, and paper discharge unit 70.

As FIG. 1 illustrates, image reading unit 20 is comprised of original placing tray 21 on which the original to be printed is placed, original transport roller pair 22 which transports the original from tray 21, image sensor 23, e.g., a contact type image sensor which optically reads the image on the original and converts it to electrical signals, and original discharge tray 24 into which the read out original is finally deposited.

The original image reading process is conducted by placing the original on tray 21 and depressing a stencil preparation start switch on the control panel of the printing machine (the control panel is known in the art but not shown in the figure).

Thermal stencil making unit 30 includes thermal head 31, which is comprised of an array of multiple heat generating elements disposed vertically over the stencil sheet as viewed in the figure, and platen roller 32 disposed oppositely to thermal head 31. Stencil roll holding section 29 is provided on the left side of stencil making unit 30 as means of removably supporting stencil roll R, stencil roll R being a continuous rolled material of heat-sensitive stencil sheet S. In adjacent proximity to thermal head 31 and platen roller 32 are a pair of vertically disposed stencil transport rollers 33, stencil cutter 36 comprised of upwardly pointing fixed cutoff blade 34 and stationary cutoff blade 35, and stencil guide 39 comprised of lower guide plate 37 and upper guide plate 38, for providing means of guiding already imaged stencil sheet S to clamp 6 on printing drum 2.

In regard to the operation of stencil making unit 30, stencil sheet S fed out of roll R is transported past thermal head 31 by means of platen roller 32 and stencil feed rollers 33 during which perforations corresponding to an image are made by heat in a stencil sheet S. Cutter 36 then shears stencil sheet S to an appropriate size after which stencil sheet S is transported to printing drum 2. The length of the sheared off portion of stencil sheet S is determined by means of paper length sensor 600 which monitors the length of the printing paper. For example, if A3 size paper is loaded, stencil sheet S would be cut to a corresponding size of 320 mm×515 mm, or if A4 paper were loaded, stencil sheet S would be cut to a corresponding size of 320 mm×310 mm.

The leading edge of sheared stencil sheet S is transported past cutter 36 to a specific position within stencil guide 39 where standby sensor 45 is provided. Standby sensor 45 provides a means of putting the operation of stencil making unit 30 into a waiting state before the next stencil making cycle. The leading edge of sheared stencil sheet S triggers sensor 45, the timing of this trigger point initiating an operation in which platen roller 32 and transport rollers 33 rotate only a specified time during which perforations are made in stencil sheet S, by thermal head 31, based on the image signals output by image sensor 23 of image reading unit 20.

As shown in FIG. 1, removal unit 50 is equipped with stencil removal finger 51, said removal finger being pivotably supported by shaft 52 and connected to solenoid 53 at its lower extremity part. Stencil removal finger 51 is rotatably driven around shaft 52 within a specific angular range. In other words, the upper extremity of finger 51 is able to pivot from a standby position separated from printing drum 2 to a stencil removal position in adjacent proximity to the circumferential surface of printing drum 2.

Stencil removal finger 51, when brought into adjacent proximity to the surface of printing drum 2, is thus able to separate and guide stencil sheet S off of and away from the surface of printing drum 2. A stencil removal transport means is provided adjacent to the finger 51 (on the right side of the finger 51 as seen in FIG. 1) in the form of a pair of stencil removal rollers 56 (comprised of upper and lower transport rollers 54 and 55), rollers 56 being driven by stencil removal motor 83 as means of transporting separated stencil sheet S away from printing drum 2. Used stencil container 57, provided immediately adjacent to removal rollers 56, provides a space into which rollers 56 can transport and deposit stencil sheet S. Moreover, the aforesaid transport means is not limited to the roller based structure as presented in this embodiment, but can also be structured as a conveyor belt mechanism.

Paper feed unit 60 is comprised of vertically traversing elevator table 61 on which a stack of printing paper P is placed (vertical traversing mechanism not shown in the figure), pickup roller 62 which is capable of removing single sheets from the paper stack, feed clutch 63 which intermittently connects main motor 3 to pickup roller 62, and paper transport roller pair 64 which feeds single sheets of paper P between printing drum 2 and press roller 10 through a synchronously timed operation.

Figure 5A:
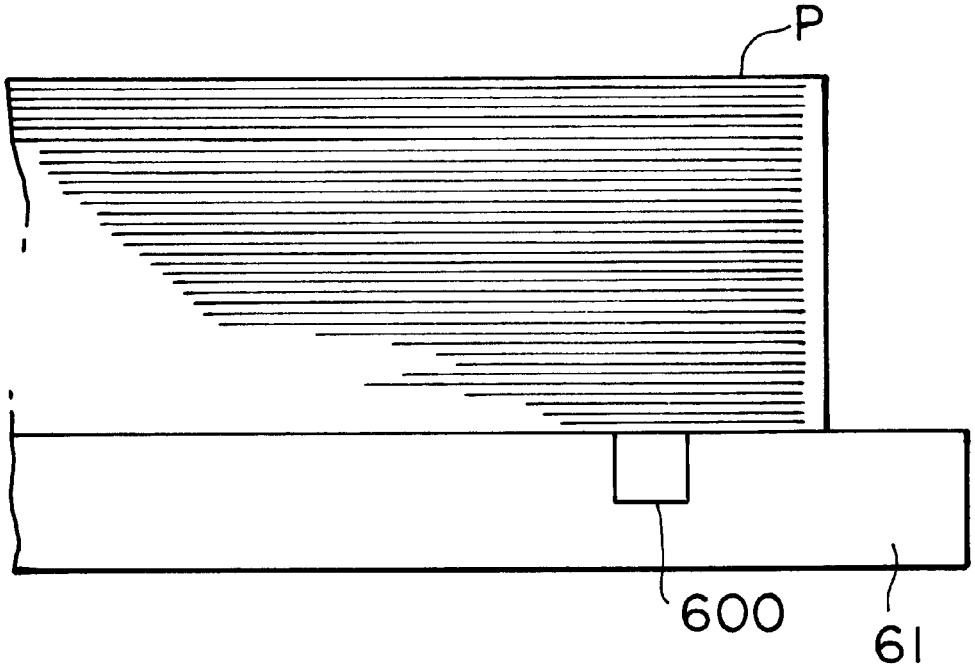
FIG. 5A and FIG. 5B are side views of the printing paper tray showing the positional relationship between the printing paper and paper size sensor of the printing machine shown in FIG. 1.
Figure 5B:
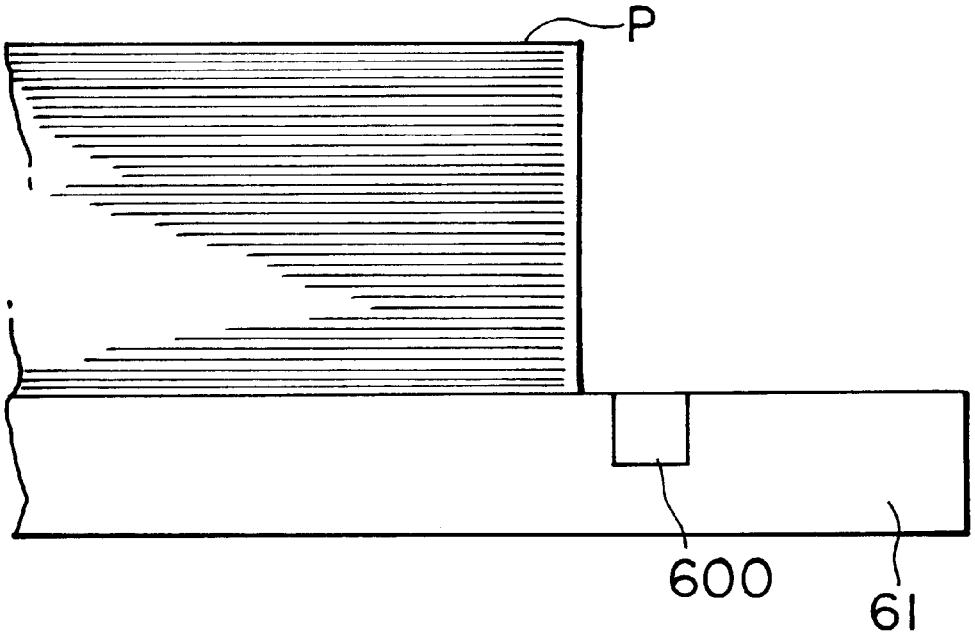

Moreover, elevator table 61 is equipped with paper size sensor 600, thus providing for a function through which the length of the paper on the elevator table can be determined. For example, as illustrated in FIG. 5A, a paper size longer than size A4 will cover sensor 600 and thereby induce the output of an ON signal. As shown in FIG. 5B, a paper size shorter than size A4 will not cover the sensor and thereby cause the sensor to output an OFF signal. Sensor 600 may take the form of an optically activated sensor, a mechanically activated sensor, or any other type of sensor known in the art that is appropriate to the application.

Paper discharge unit 70 is comprised of separator finger 71 which separates printing paper P from printing drum 2, and belt conveyor transport mechanism 73 which transports printing paper P from printing drum 2 to the sheet discharging stand 72.

As illustrated in FIG. 1, printing unit 40 is primarily comprised of cylindrical printing drum 2 which is rotatably installed around the center of the radial axis of printing drum 2. Printing drum 2 is driven by main motor 3 in a clockwise direction as viewed in FIG. 1. An ink-permeable region is formed in the circumferential wall of printing drum 2 to a dimension equivalent to the A3 paper size. In other words, the width of the aforesaid ink permeable region extends 300 mm in the drum's axial direction, and 440 mm along the radial circumference of the drum.

Stage member 4 is installed on the external circumference of printing drum 2, and covers the non-ink permeable region in the axial baseline direction. Stencil clamp plate 5 is attached to stage member 4, which clamps one edge of stencil sheet S in cooperation with stage member 4. Gear 17 rides on support shaft 16 of stencil clamp plate 5. As further shown in FIG. 1, clamp solenoid 18 is installed to a fixture on the frame of the printing machine (not shown in the figure). Drive gear 19*a* is powered by a clamp motor (not shown in the figure) residing within drive unit 19. The drive unit 19 is capable of moving upward and downward, as means of bringing drive gear 19*a* into mesh with the aforesaid gear 17, through the operation of clamp solenoid 18.

When drive gear 19*a* is rotatably driven in mesh with gear 17, stencil clamp plate 5, which is rotatably attached to stage member 4, pivots approximately 180-degrees in relation to stage member 4. That is, stencil clamp plate 5 is able to pivot around support shaft 16, rotatably moving from the position at which the leading edge of stencil sheet S is clamped (as shown in FIG. 1) to a point where stencil clamp plate is located approximately 180-degrees away from the aforesaid clamping position and does not clamp stencil sheet S.

Ink supply unit 9, which is comprised primarily of squeegee roller 7 and doctor rod 8, is installed within printing drum 2 as means of supplying ink to the internal circumferential surface of printing drum 2. Press roller 10 is movably installed below printing drum 2 in a manner as to be able to move upward to a position in contact with printing drum 2 and downward to a position released therefrom. Press roller 10 presses printing paper P against the outer circumference of printing drum 2, through a timed operation, thus allowing the transfer of an ink image to paper P through stencil sheet S.

Figure 2:
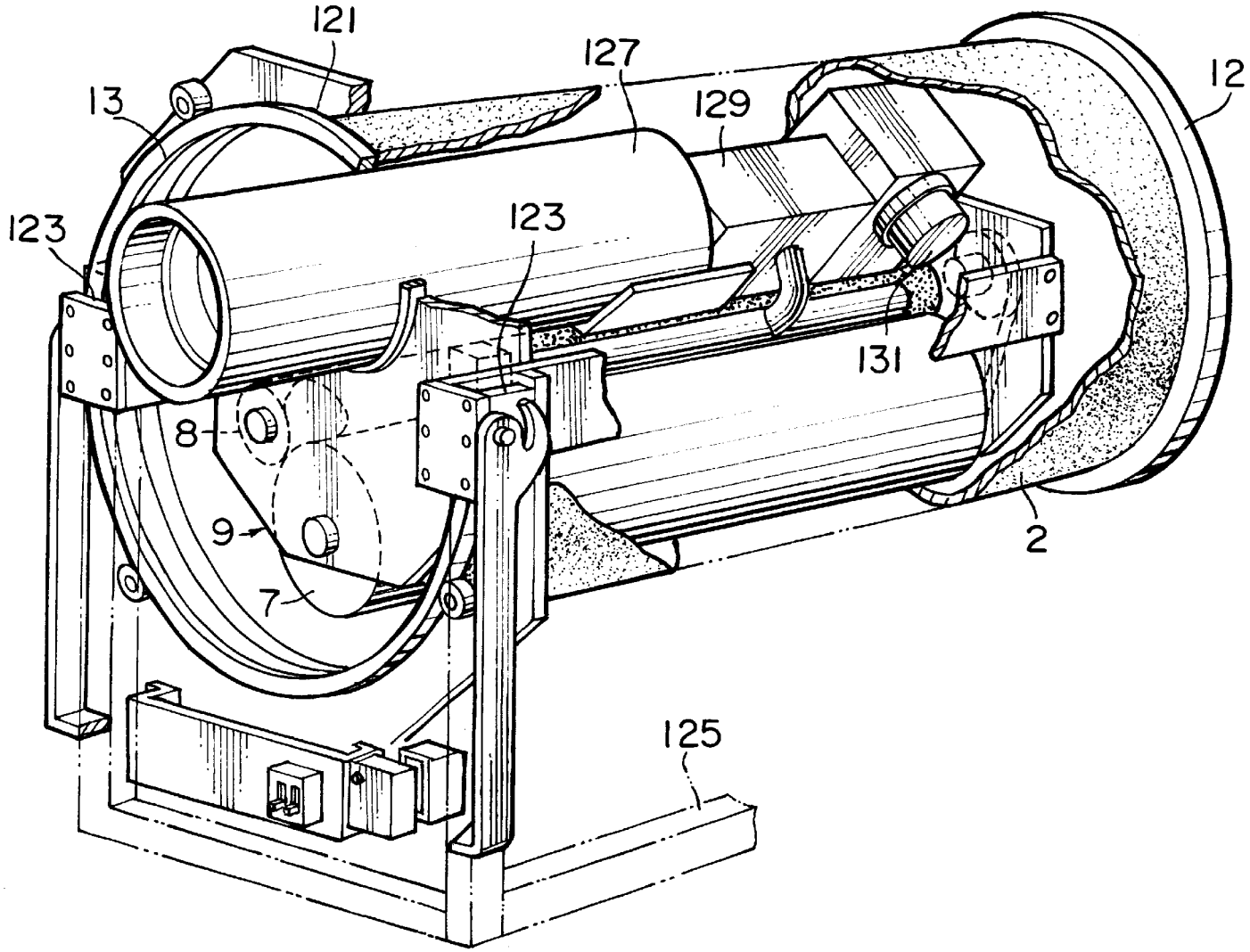
FIG. 2 is an oblique view of the printing drum part of the invention.

As shown in the oblique view provided by FIG. 2, printing drum 2 is a single piece structure rotatably supported within end plate 121. Connector joint 123 is integrally formed to end plate 121, and provides means whereby printing drum 2 can be removably installed to main frame 125, thus forming a structure through which printing drum 2 can be removed from or installed to printing machine 1. Moreover, printing drum 2 incorporates ink storage bottle 127, ink pump 129 as means of supplying ink to ink supply unit 9, and ink pump drive motor 131 installed therein. Examined Japanese patent Application Publication (Kokoku) Nos. 62-28758 and 4-46236 provide more detailed information on the structure that allows the removal and installation of printing drum 2 to printing machine 1.

Figure 3A:
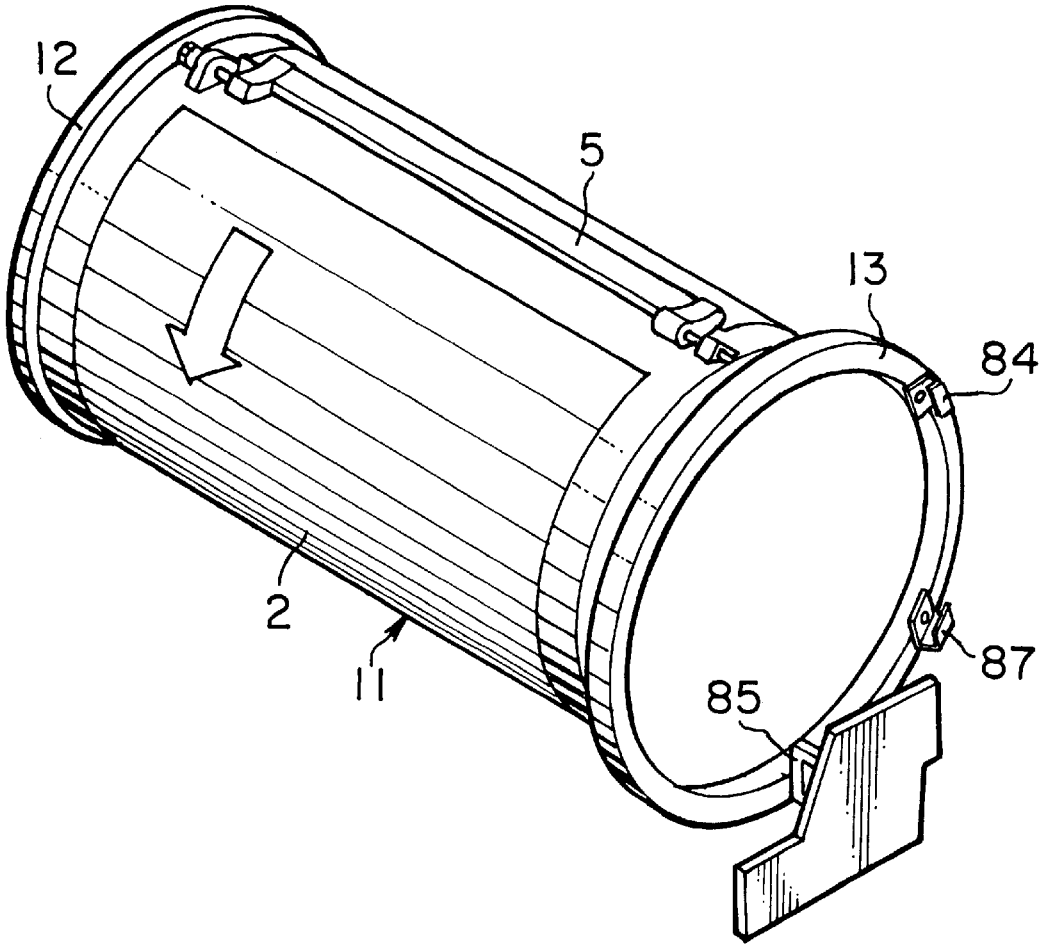
FIG. 3A is an oblique view of the printing drum specifically describing the drum position sensor and trigger plate.

FIG. 3A provides another oblique view of printing drum 2 where drum flanges 12 and 13 are installed around the openings formed at the ends of cylindrical drum wall 11. Flanges 12 and 13 are secured to the ends of drum wall 11 by screws or other like fastening means, thus providing a structure which reinforces the cylindrical shape of the whole drum. While not shown in the figure, one or two mesh screens are installed against the outer circumferential surface of printing drum 2 as means of aiding the uniform distribution of printing ink thereon.

Figure 3B:
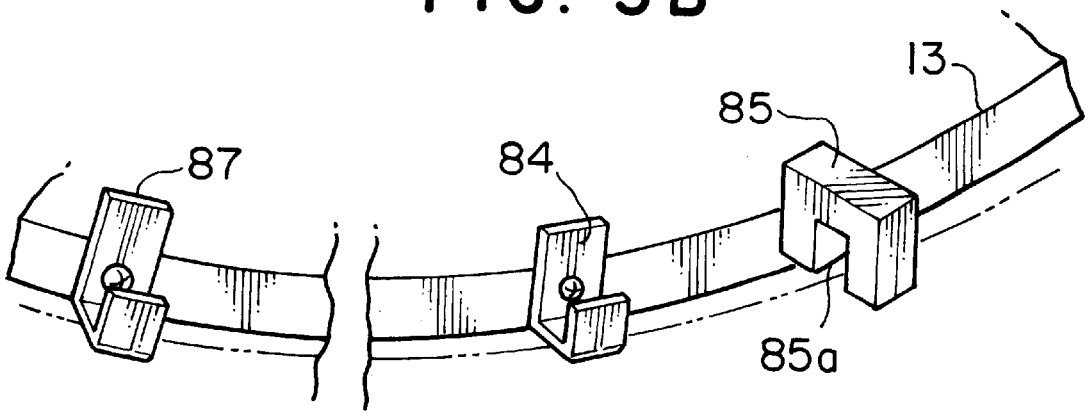
FIG. 3B is an enlarged oblique view of the same drum position sensor and trigger plates.
Figure 4:
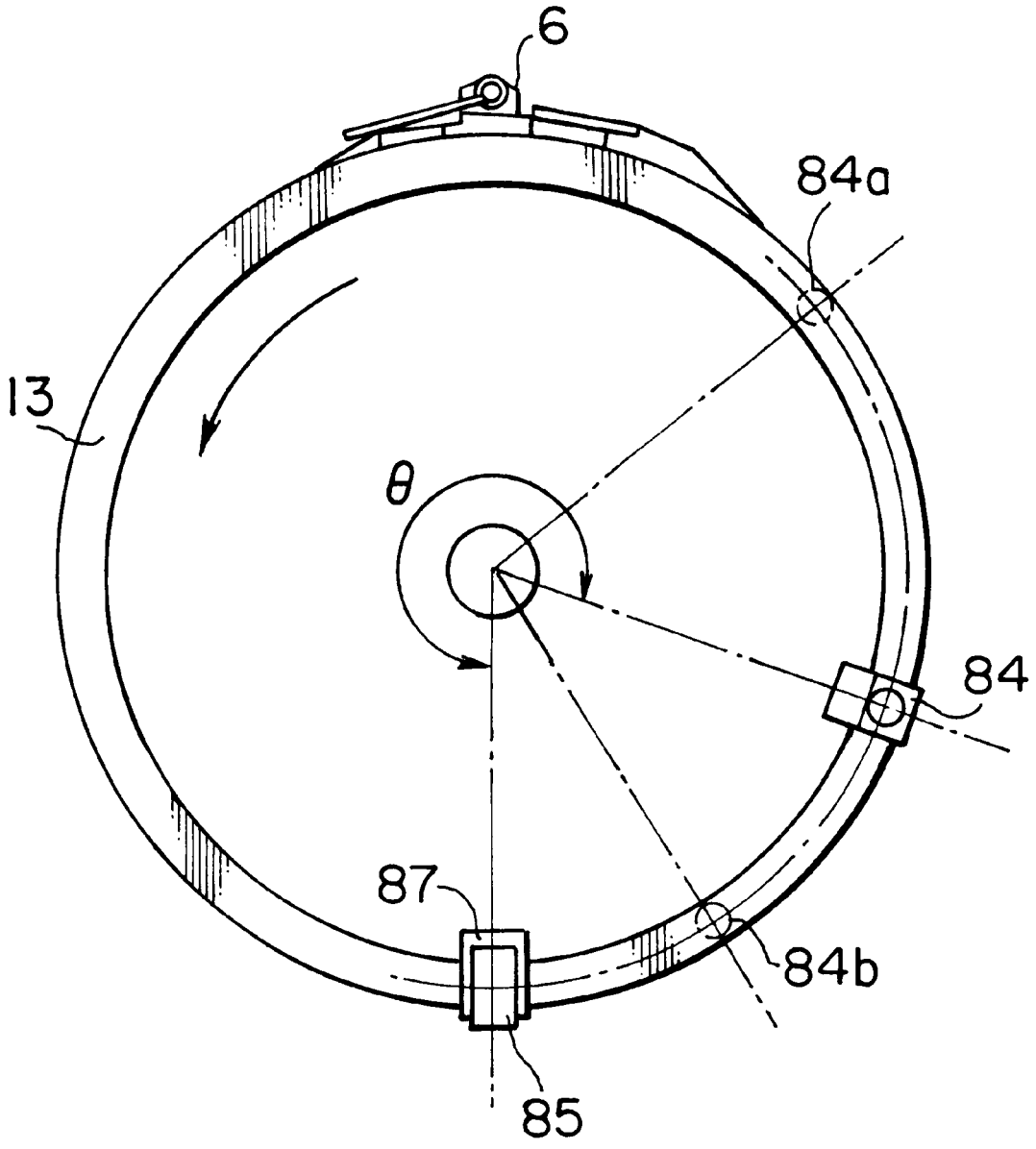
FIG. 4 is an end view of the printing drum shown in FIG. 3.

As shown in FIG. 4, first trigger plate 87 is installed to the peripheral edge of either flange 12 or flange 13 on either end of printing drum 2. First trigger plate 87 overlaps drum position sensor 85 when clamp unit 6 is at the 12 o'clock position which is the baseline position for printing drum 2, that is, the position at which printing drum 2 stops, the position at which stencil clamp plate 5 operates, and the position at which printing drum 2 can be removed from the printing machine. While FIG. 4 shows drum position sensor 85 structured as an interruption type photo sensor activated by first trigger plate 87, the structure may be replaced with other means having the same function. FIG. 3B shows a detailed view in which sensor 85 has a groove 85*a*. When first trigger plate 87 passes through the groove 85*a* and shields the light of the groove, sensor 85 is induced to output a signal indicating that drum 2 is at the baseline position.

As stated previously, the invention provides control means whereby the aforesaid pair of stencil removal rollers 56 can be immediately stopped after stencil sheet S has been deposited into used stencil container 57. The aforesaid control means allows the rotation of removal rollers 56 only to the extent necessary to deposit stencil sheet S into used stencil container 57, and stops rollers 56 immediately after the stencil transport operation into used stencil container 57 is completed. When the stencil has been used for printing and is ready to be discarded, printing drum 2 turns at a fixed speed in synchronization with the rotation of rollers 56 and in the direction shown by the arrow in FIG. 1. Removal rollers 56 turn at a specific fixed speed that will result in the complete transport of stencil sheet S into used stencil container 57 within one rotational revolution of printing drum 2. Thus, the operating time of stencil removal rollers 56, that is, the time needed to transport and insert stencil sheet S into used stencil container 57, can be related to the rotational angle of the printing drum during the stencil removal cycle. FIG. 4 shows an example of how this is accomplished. Second trigger plate 84 is provided at a location on flange 12 or 13 on either side of printing drum 2, and is specifically positioned so as to establish rotational angle θ. Angle θ represents the extent of rotation of printing drum 2 during which stencil removal rollers 56 must complete the transport and insertion of an A4 length stencil into used stencil container 57. In other words, second trigger plate 84 is located so as to establish a rotational distance from first trigger plate 85 only to the extent of angle θ in a direction opposite to the rotating direction of printing drum 2. More specifically, angle θ is established as a 328-degree angle to provide for a circumferential distance equivalent to B4 size paper, a 290-degree angle for a circumferential distance equivalent to A4 length size paper, a 240-degree angle for a circumferential distance equivalent to A4 width size paper, and a zero-degree angle for a circumferential distance equivalent to an A3 size paper. In cases where printing drum 2 is designed to accommodate an A3 paper length, second trigger plate 84 and first trigger plate 87 could be provided as one and the same trigger plate. Moreover, while the FIG. 4 embodiment depicts second trigger plate 84 employed exclusively to designate a circumferential distance equivalent to an A4 length size paper length, multiple trigger plates may also be installed, if so desired, to hole 84*a* or 84*b* in drum flange 12 or 13 by means of screws or rivets, as means of establishing a circumferential distance equivalent to the width dimension of A4 width or B4 size paper.

Second trigger plate 84 operates as a sensor interrupt mechanism which, as shown in the figures, is installed in a manner similar to first trigger plate 87 so as to pass through groove 85*a* of drum position sensor 85. Therefore, in cases when paper size sensor 600 monitors A4 size printing paper, the operation in which rotating printing drum 2 carries second trigger plate 84 through groove 85*a* in drum position sensor 85 can be applied as means of terminating the rotation of rollers 56 to prevent their further unnecessary rotation. Moreover, this operation eliminates the possibility of previously removed stencils from becoming entwined around upper transport roller 54 or lower transport roller 55 and erroneously ejected as a result of the excessive and unnecessary rotation of said rollers.

An alternate means of monitoring the rotational angle of printing drum 2 may be provided in the form of an encoder mechanism (not shown in the figures) capable of detecting the rotational angle of the printing drum 2 or the output shaft of main motor 3. The aforesaid encoder would thus provide control means through which the rotation of removal rollers 56 and corresponding transport of stencil sheet S could be terminated in relation to rotational angle θ of printing drum 2 during the stencil removal cycle. The aforesaid encoder may monitor the rotational angle of printing drum 2 by means of an optical interrupt type of sensor triggered by the interruption of a light beam projected through a disc into which a radial pattern of 360 slits is formed. As in FIG. 4, with first trigger plate 87 overlapping drum position sensor 85 to establish the drum baseline position, the encoder based control means can be structured so as to control the rotational termination of stencil removal rollers 56 in relation to specific standard paper sizes. For example, the detection of 328 trigger cycles would signal that the surface of printing drum 2 has rotated through an angle equivalent to a B4 size paper length, 290 trigger cycles an A4 length size paper length, and 240 trigger cycles an A4 width size paper width. Moreover, if printing drum 2 is able to accommodate an A3 paper size length, the return of printing drum 2 to the baseline position would result in the output of a signal on which the rotational termination of stencil removal rollers 56 could be based.

Various mechanisms can be employed as means of stopping the rotation of stencil removal rollers 56. These include a mechanism to stop operation of stencil removal motor 83, a clutch mechanism installed between lower transport roller 55 and motor 83, said clutch mechanism being capable of releasing the connection between roller 55 and motor 83 in response to operation of the aforesaid monitoring means, or a mechanism capable of movably separating upper transport roller 54 and lower transport roller 55.

Figure 9:
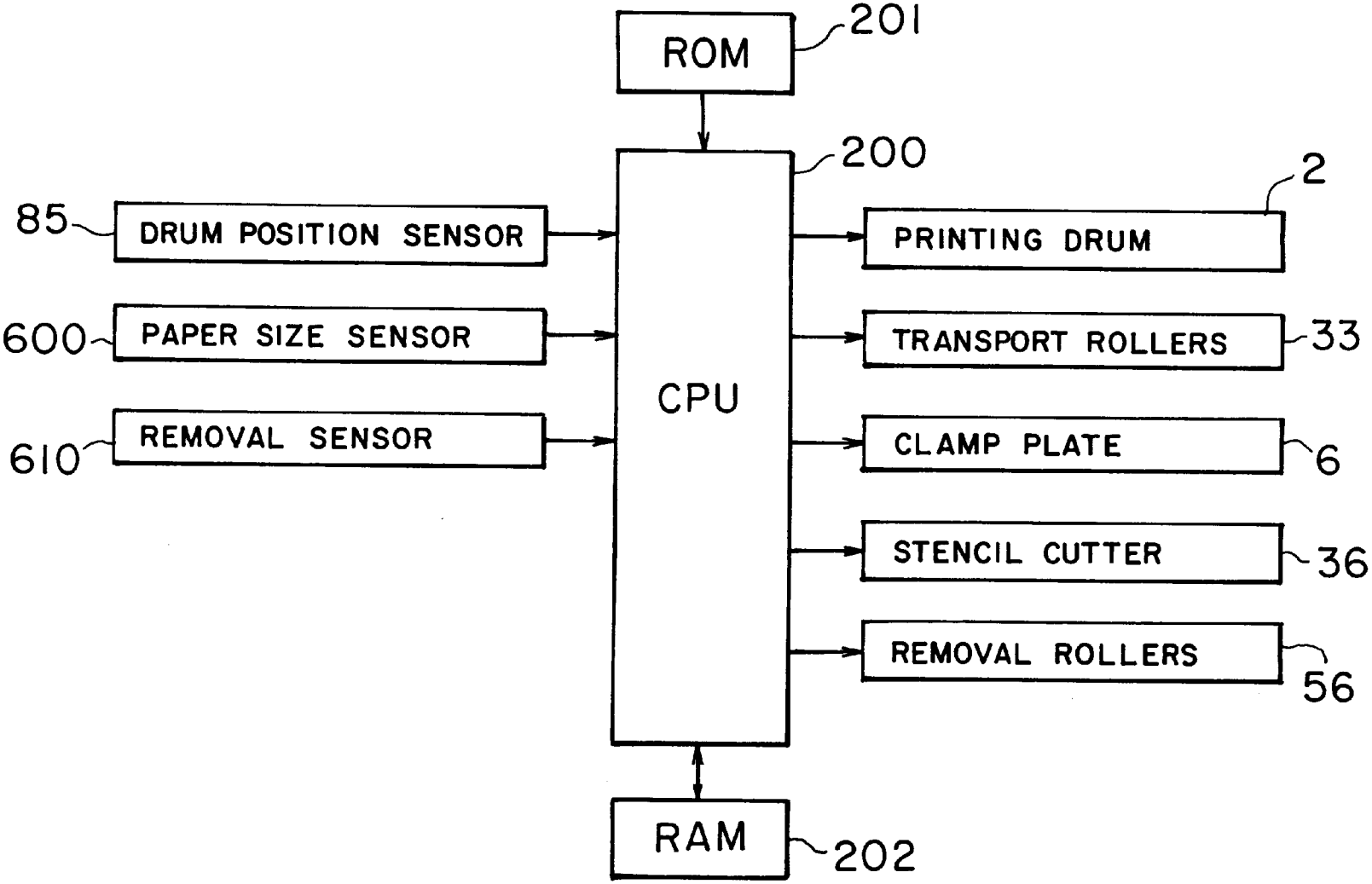
FIG. 9 is a schematic diagram describing a control system of the printing machine shown in FIG. 1.

FIG. 9 presents an abbreviated schematic view of one embodiment of the control means applied to printing machine 1. This control system utilizes second trigger plate 84, as shown in FIG. 4, as a method of monitoring the point in time at which used stencil sheet S is completely deposited into used stencil container 57. This microprocessor-based control system is comprised of CPU 200, appropriate programs stored therein, ROM (read only memory) 201, and RAM (random access memory) 202, and controls the operation of printing drum 2, stencil transport rollers 33, clamp plate 6, stencil cutter 36, and stencil removal rollers 56 based on data received from paper size sensor 600.

Figure 6:
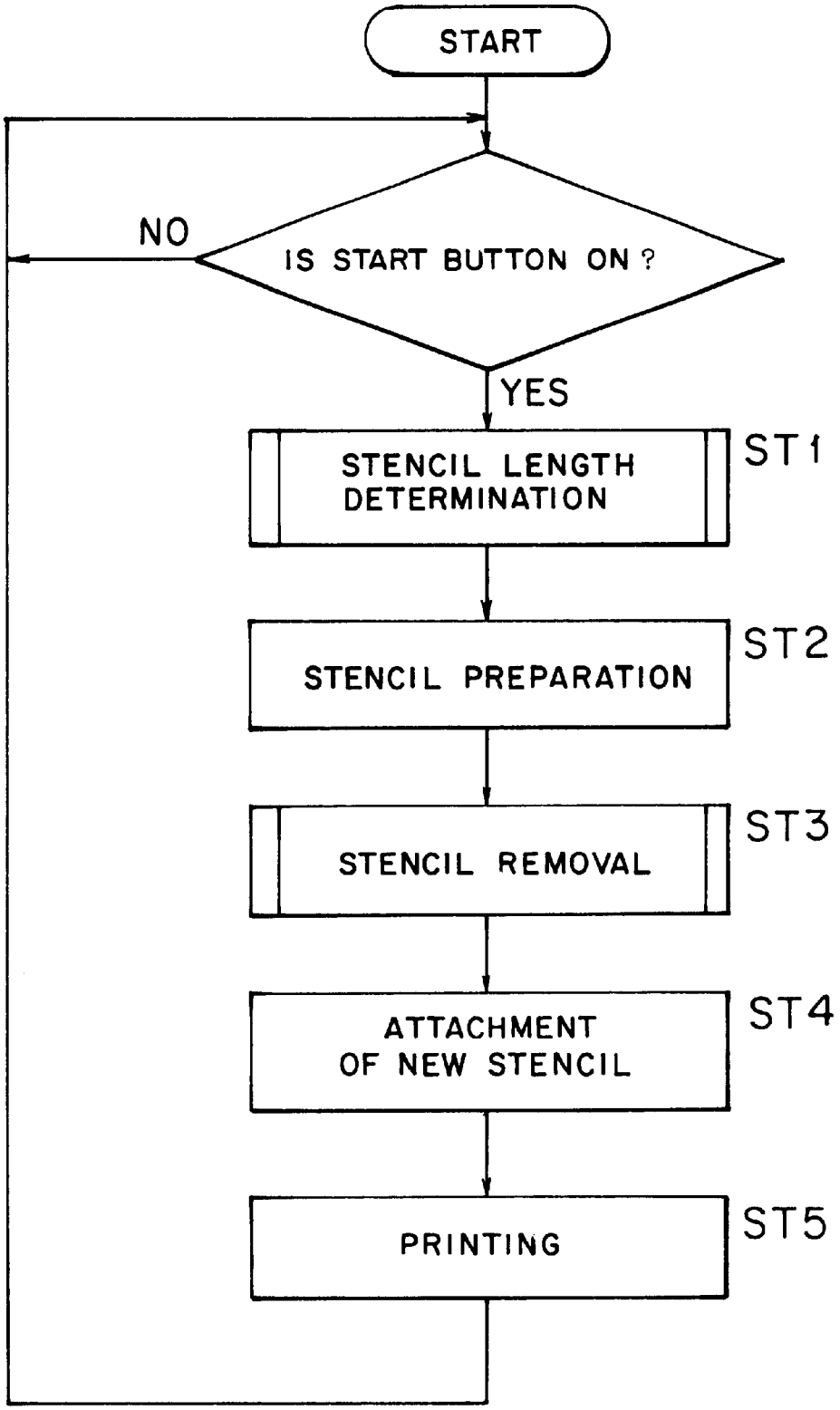
FIG. 6 is a flow chart outlining the continuous operation of the printing machine shown in FIG. 1.
Figure 7:
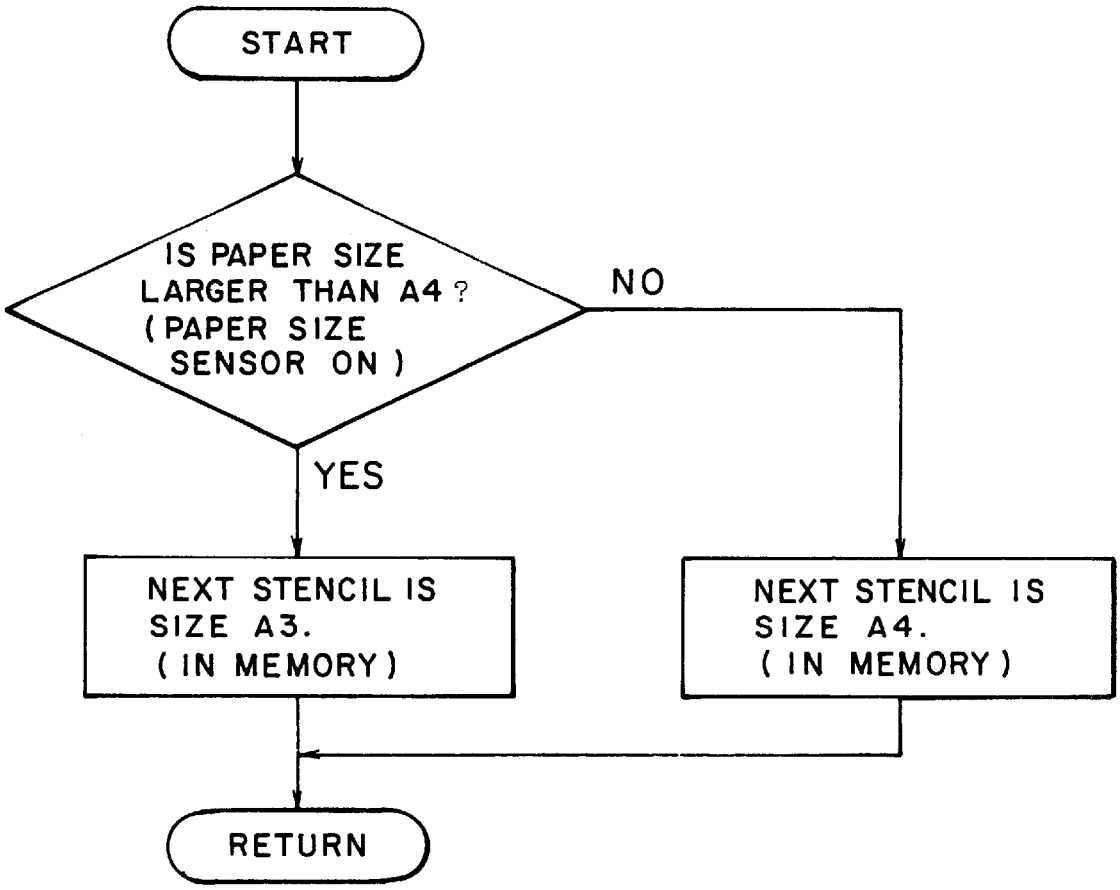
FIG. 7 is a flow chart describing the operation of the stencil length specifying means shown in FIG. 6.

FIG. 6 presents a flowchart showing the operational sequence of the printing machine as controlled by the control system shown in FIG. 9. Activation of the START button on the control panel (not shown in the figures) initiates Step 1 (ST1) at which data from paper sensor 600 is processed, paper sensor 600 serving as the aforesaid stencil length specifying means. More specifically, as shown in the FIG. 7 flow chart, the length of the paper loaded in the printing machine is determined to be smaller than size A4 as a result of paper size sensor 600 remaining exposed as shown in FIG. 5B. Conversely, if paper sensor 600 were to be covered by the printing paper, the control system would determine that a paper size larger than A4 is loaded. The sequence then proceeds to Step 2 (ST2) where the original image is read out by image reading unit 20 while thermal stencil making unit 30 prepares stencil sheet S from the roll of stencil sheet. An image is formed on stencil sheet S based on the image read-out data supplied by image reading unit 20. While Step 2 (ST2) is being executed, the Step 3 (ST3) process initiates in which the already used stencil attached to the printing drum is removed by used stencil removal unit 50. After the stencil removal operation is completed, the leading edge of stencil sheet S stops at and is secured to printing drum 2 by means of stencil clamp plate 5. With stencil sheet S thusly secured to clamp 5, stencil sheet S is pulled onto and around the circumference of printing drum 2 by the rotation of said drum. While the stencil is winding around the circumference of printing drum 2, stencil cutter 36 is activated to shear stencil sheet S to a size determined by the data obtained through the stencil length specifying operation which was executed in Step 1 (ST1). In other words, if the length of the printing paper is less than size A4, stencil sheet S will be sheared to a corresponding A4 length of 310 mm. If the length of the printing paper is monitored as being longer than size A4, stencil sheet S will be sheared to an A3 length of 515 mm. This completes the stencil preparation operation in Step 4 (ST4). Paper size data is held in RAM 202 (FIG. 9) which serves as the aforesaid paper length memory means, and is held in RAM 202 until the stencil removal operation (ST3) is completed. In cases where the used stencil removal (ST3) and stencil preparation operation (ST2) are executed simultaneously, RAM 202 may be equipped with two memory regions as means of holding data pertaining to the length of the stencil being removed, and data pertaining to the length of the stencil being prepared for printing.

Inputting the number of copies to be printed and pressing the START button on the printing machine's control panel (not shown in the figures) will result in the rotational movement of printing drum 2 simultaneous with synchronous feed of printing paper P, by means of paper feed unit 60, between press roller 10 and printing drum 2 to which press roller 10 is held in intermittent pressure contact. The ink inside of printing drum 2 is thus transferred through the orifices in stencil sheet S to printing paper P to create the printed image. The printed paper is then separated from printing drum 2 by means of paper removal unit 70, and deposited on paper delivery stand 72. This process is shown as Step 5 (ST5) in the flow chart in FIG. 6. The printing drum and paper feed mechanism will continue to repeatedly cycle until the number of actual printed copies equals the number set into the control panel.

FIG. 8 presents an operational flow chart depicting the control function applied to the removal rollers 56 when the stencil removal cycle (ST3 in FIG. 6) is activated.

As mentioned above, the used stencil removal process initiates in unison with the preparation of the new stencil (ST2). Main motor 3 begins operation, the printing drum rotates (ST31), first trigger plate 87 moves into a position to activate drum position sensor 85, and main motor 3 stops with clamp plate support shaft 16 at 12 o'clock, a location which establishes the baseline position for printing drum 2 (ST32 and ST33 in FIG. 8). Clamp solenoid 18 is then activated ON, drive gear 19*a* is brought into mesh with gear 17, and the clamp motor begins operation to rotate stencil clamp plate 5 to its released (stencil unclamped) position (ST34). The used stencil removal process may initiate during the aforesaid clamp release operation, or after a specific period of time elapses after the separation of drive gear 19*a* from gear 17 as induced by solenoid 18 switching to an OFF state. Solenoid 53 then activates ON to bring stencil removal finger 51 to the stencil removal position after which motor 83 is turned on to have rollers 56 begin rotating. (ST35) while main motor 3 rotates at low speed to turn printing drum 2 (ST36). Consequently, stencil removal finger 51 is able to lift stencil sheet S off of rotating printing drum 2 and guide stencil sheet S between rollers 56 which grip and transport stencil sheet S into used stencil container 57.

When the slow rotation of printing drum 2 brings second trigger plate 84 to a position which activates drum position sensor 85 (ST37), a control operation is initiated in which the length data that is on the stencil being discarded and is held within RAM 202 is comparatively processed against the stencil length data provided by drum position sensor 85 (ST38). If the monitored stencil length data is equivalent to a length dimension of A4 or smaller, stencil removal motor 83 stops, thereby terminating the rotation of stencil removal rollers 56 (ST39). If the monitored stencil length data is larger than the A4 data held in RAM 202, printing drum 2 continues to rotate until first trigger plate 87 activates drum position sensor 85 (ST40), a position at which main motor 3 stops to terminates the rotation of printing drum 2 (ST41), and at which stencil removal motor 83 stops and terminates the rotation of stencil removal rollers 56 (ST42). The result of this operation is that removal rollers 56 deposit stencil sheet S into used stencil container 57 with only the minimum amount of rotation required to complete that deposition, thus preventing the possibility of stencils within container 57 from becoming entwined around still rotating roller 55. After this process has completed, the aforesaid stencil preparation process is executed (ST4).

For reasons of simplicity, the aforesaid embodiment explained the printing paper size determination process (ST1 in FIG. 6) as using only the A4 length dimension. This same process, however, can also be applied to monitor various paper sizes through the incorporation of multiple paper size sensors 600 which may correspond to an A4 width, A4 length, B4, A3 and other paper lengths and widths as desired. The same type of control means can be provided to synchronize the duration of the operation of the removal rollers with any size stencil on the printing drum. Moreover, while step ST37 in FIG. 8 refers to a process in which only a rotational angle of printing drum 2 equivalent to an A4 paper length is monitored as means of determining the point at which the stencil is completely removed from the printing drum, other means may also be employed for this purpose. For example, the data shown in Table 1 may be held in ROM 201 for use in comparison calculations against various angles θ of the printing drum. An encoder (not shown in the figures) can be employed as means of continually monitoring the rotational angle of printing drum 2 or main motor 3 to detect the θ angles. In this case, the control system need not be limited to monitoring specific paper sizes such as A4 and B4, but can be configured to provide the same control function for stencil removal rollers 56 for any size paper loaded in the printing machine.

TABLE 1

| paper size | A3 | B4 | A4 | A4 (width) |
|---|---|---|---|---|
| angle θ (stencil removal completion point) | 360° | 328° | 290° | 240° |

Figure 10A:
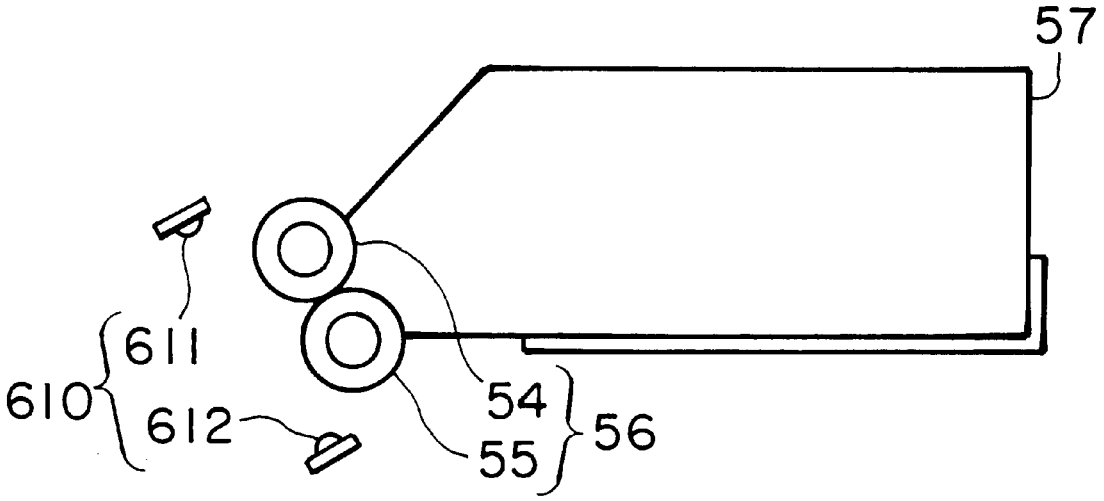
FIG. 10A and FIG. 10B are enlarged views of the sensors that monitor the stencil removal operation for the printing machine shown in FIG. 1.
Figure 10B:
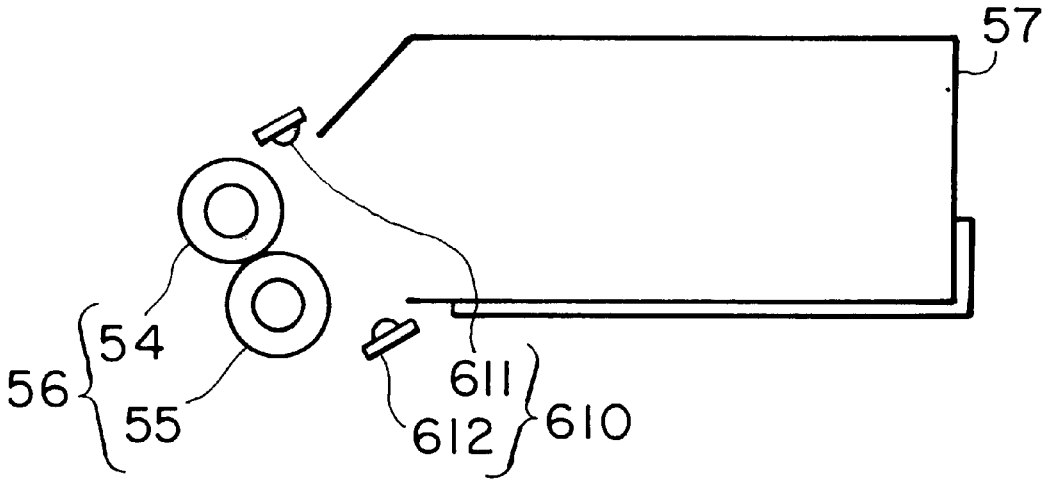

While the stencil length specifying means is required in the previous embodiment, the following embodiment provides means whereby the use of removal sensor 610, which is installed in proximity to used stencil container 57, eliminates the need for the stencil length specifying means. The following embodiment describes a control function through which the duration of the used stencil transport means can be controlled, through the use of removal sensor 610, in relation to the length of the stencil on the printing drum. As shown in FIG. 10, removal sensor 610 can be installed in proximity to stencil removal rollers 56 at used stencil container 57. Removal sensor 610 may be installed between rollers 56 and printing drum 2 as shown in FIG. 10A, or between rollers 56 and container 57 as shown in FIG. 10B. Removal sensor 610 may be installed in proximity to the used stencil transport means in cases where the sensor is of a specific configuration or if a conveyor-type stencil transport means is employed.

The FIG. 10 embodiment describes sensor 610 as an illuminated photo sensor comprised of emitter element 611 and receiver element 612. Emitter element 611 may be positioned above receiver element 612, or the reverse orientation may also be employed on being removed from printing drum 2, used stencil sheet S passes between sensor elements 611 and 612 and into used stencil container 57, thus activating sensor 610 and providing means of determining exactly when a used stencil is entering container 57 during the stencil removal process. As shown in FIG. 9, the signal from sensor 610 is fed to CPU 200 and used to control the rotational termination of removal rollers 56. While this embodiment describes sensor 610 as an illuminated photo sensor, a reflective photo sensor or contact sensor like a microswitch may also be used to the same purpose.

Figure 11:
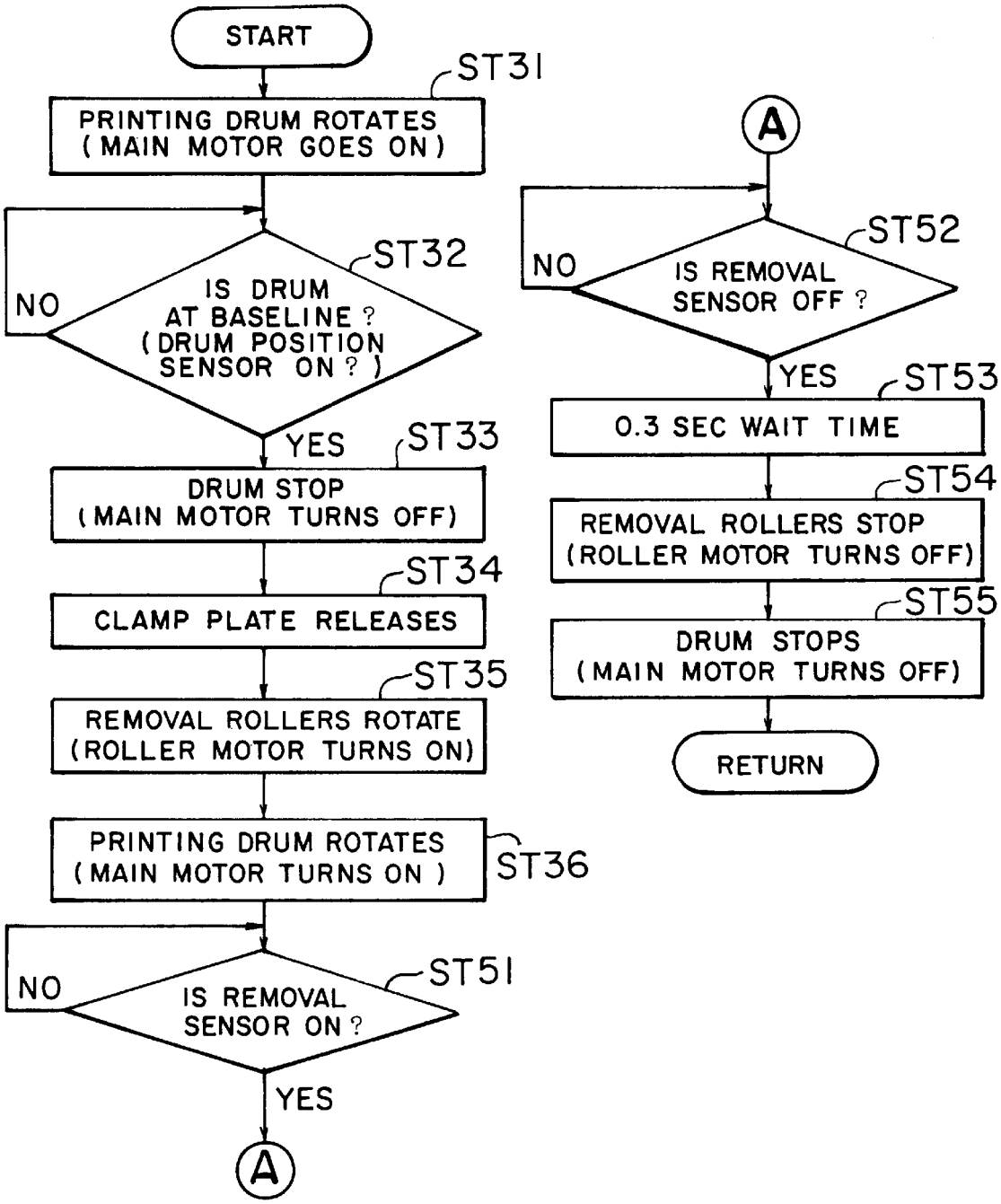
FIG. 11 is another flow chart describing the operation of the stencil removal process shown in FIG. 6.

By utilizing the signal from removal sensor 610, the stencil removal process (ST3 in FIG. 6) can be executed based on the FIG. 11 flow chart. In other words, after the stencil preparation process is completed, control of the stencil removal process is initiated in a manner similar to FIG. 8. Main motor 3 turns ON (ST31) and stops when printing drum 2 reaches the baseline position (ST32 & ST33). Stencil clamp plate 5 is then released (ST34), stencil removal motor 83 turns ON to rotate stencil removal rollers 56, and the stencil is removed from the printing drum and transported into used stencil container 57 (ST35 & ST36).

Removal sensor 610, which is installed in proximity to removal rollers 56, is activated by the passage of the stencil therebetween. Removal sensor 610 changes to an ON state when activated by the traversing stencil (ST51), and to an OFF state when that traverse through the sensor terminates (ST52). This is followed after lapse of a predetermined time (ST53) by stencil removal motor 83 turning OFF, removal rollers 56 stopping rotation (ST54), main motor 3 turning OFF, and printing drum 2 stopping (ST55). This completes the stencil removal cycle after which a new stencil is prepared and printing executed in a continuous process.

In the FIG. 11 embodiment, removal rollers 56 are able to transport the stencil completely into used stencil container 57, regardless of the length of the stencil on printing drum 2, as a result of removal sensor 610 turning OFF at the point at which traverse through sensor 610 ends. Excessive rotation of removal rollers 56 is prevented, and the problem of stencils becoming entwined around the rollers is eliminated because removal rollers 56 stop rotating precisely at the point at which the end of stencil traverse deactivates sensor 610.

In cases where, as shown in FIG. 10A, stencil removal sensor 610 is located on the side of rollers 56 facing printing drum 2, part of the stencil will be protruding from container 57 when sensor 610 turns OFF. In order to completely deposit the stencil into container 57 with this sensor location, it is desirable to set the roller rotation stop point (ST54), for example, 0.3 seconds (as in FIG. 11) after stencil traverse through the sensor (ST53). In cases where sensor 610 is located between removal rollers 56 and container 57 as shown in FIG. 10B, or where the rotation of rollers 56 is allowed to stop inertially even in the arrangement shown in FIG. 10A, the aforesaid 0.3 seconds of waiting time (ST53) may be eliminated. While this embodiment portrays removal rollers 56 as being driven by stencil removal motor 83, rollers 56 may be driven by a different power source through a clutch mechanism.

It is obvious that the invention may also be applied to stencil printing machines of the type that employ multiple replaceable printing drums that accommodate A3, A4 and/or other paper sizes, and means of shearing stencils to specific lengths in relation to the size of the printing regions on the aforesaid printing drums.

The invention puts forth a structure for a stencil printing machine of the type capable of shearing a prepared stencil to a length corresponding to a size of the printing paper, attaching the aforesaid stencil to the circumferential surface of a printing drum, determining the length of the aforesaid stencil based on the size of the printing paper, and transporting the aforesaid stencil into a container through a stencil transport means whereby the operation of said removal means can be precisely stopped immediately after said stencil is deposited into the aforesaid container. The benefits provided by this structure are not only the elimination of extended unnecessary operation of the aforesaid transport means, but the elimination of the problem in which previously deposited stencils become entangled in said transport means, and the elimination of the problem of previously deposited stencils being mistakenly transported out of the aforesaid container.

What is claimed is:

1. A stencil printing machine including:

a stencil adapted to be sheared off a continuous roll of stencil sheet to a length determined by a selected size of printing paper, a printing drum onto which said stencil is mounted, a used stencil container, a transport means for transporting and inserting said stencil into said used stencil container after said stencil is removed from said printing drum;

said stencil printing machine firther comprising:

a stencil length specifying means for specifying the length of the aforesaid stencil according to the selected size of printing paper when the aforesaid stencil is prepared for printing, and a control means for controlling an operation amount of the aforesaid transport means in relation to the length of the aforesaid stencil as specified by the aforesaid stencil length specifying means.

2. A stencil printing machine defined in claim 1, in which said control means comprises:

memory means for holding stencil length data as specified by said stencil length specifying means, monitor means for monitoring the operation amount of said transport means whereby said operation amount necessary to completely carry the aforesaid stencil to and into said used stencil container by said transport means is detected, and termination means for stopping operation of said transport means based on a comparison calculation between a stencil length corresponding to said operation amount monitored by said monitoring means and said stencil length data held by said memory means.

3. A stencil printing machine defined in claim 2, wherein said transport means completely transports and deposits said stencil into said used stencil container within one rotational cycle of said printing drum, and said monitor means comprises a printing drum rotational angle monitoring mechanism whereby a rotational angle of said printing drum at which said used stencil is completely transported and deposited into said used stencil container can be monitored.

4. A stencil printing machine defined in claim 3, wherein said monitor means comprises a first trigger plate provided on said printing drum, a second trigger plate provided on said printing drum at a point separated from said first trigger plate in a direction opposite to a drum rotating direction by said rotational angle at which said used stencil is completely transported and deposited into said used stencil container, and, a stationary sensor which detects said first and second trigger plates, in which said first trigger plate is located to be detected by said sensor when said rotational cycle of printing drum is started.

5. A stencil printing machine defined in claim 3, in which said monitor means continuously monitors the rotational angle of said printing drum, and comprises a detecting means which detects said rotational angle at which said used stencil is completely transported and deposited into said used stencil container.

6. A stencil printing machine including means for receiving stencil sheet from a continuous roll of stencil sheet, cutting means to shear off a continuous roll of stencil sheet to a stencil having a length determined by a selected size of printing paper, a printing drum, means for mounting the stencil onto said printing drum, means for removing the stencil from said printing drum, and means for transporting and inserting the stencil removed from said printing drum into a used stencil container, said stencil printing machine further comprising:

a stencil length specifying means for specifying the length of the stencil according to a selected size of printing paper when a stencil is prepared for printing, and a control means for controlling said transport means in relation to the length of the stencil as specified by said stencil length specifying means.

7. A stencil printing machine as defined in claim 6, wherein said stencil printing machine is provided with a continuous roll of stencil sheet for feeding to said receiving means.

* * * * *